US010039690B2

(12) United States Patent
Kramer

(10) Patent No.: US 10,039,690 B2
(45) Date of Patent: Aug. 7, 2018

(54) DUAL MUSCLE ROLLER

(71) Applicant: Marcus Kramer, San Diego, CA (US)

(72) Inventor: Marcus Kramer, San Diego, CA (US)

(73) Assignee: Innovation Ethos, LLC, El Cajon, CA (US)

( * ) Notice: Subject to any disclaimer, the term of this patent is extended or adjusted under 35 U.S.C. 154(b) by 224 days.

(21) Appl. No.: 15/245,401

(22) Filed: Aug. 24, 2016

(65) Prior Publication Data

US 2017/0056284 A1 Mar. 2, 2017

Related U.S. Application Data

(60) Provisional application No. 62/210,950, filed on Aug. 27, 2015, provisional application No. 62/376,882, filed on Aug. 18, 2016.

(51) Int. Cl.
*A61H 15/00* (2006.01)

(52) U.S. Cl.
CPC . *A61H 15/0092* (2013.01); *A61H 2015/0014* (2013.01); *A61H 2201/0192* (2013.01); *A61H 2201/1253* (2013.01); *A61H 2201/164* (2013.01); *A61H 2201/1635* (2013.01); *A61H 2201/1669* (2013.01); *A61H 2203/0406* (2013.01); *A61H 2205/10* (2013.01)

(58) Field of Classification Search
CPC ..... A61H 15/0092; A61H 2203/0406; A61H 2201/1669; A61H 2201/164; A61H 2201/1635; A61H 2201/0192; A61H 2201/1253; A61H 2205/10; A61H 2015/0014
See application file for complete search history.

(56) References Cited

U.S. PATENT DOCUMENTS 3,759,250 A * 9/1973 Salata ..... A61H 15/00 601/122
9,616,284 B1 * 4/2017 Aganyan ..... A63B 23/00
2005/0159688 A1 * 7/2005 Sakamoto ..... A61H 15/0092 601/123
2013/0289454 A1 * 10/2013 Wang ..... A61H 11/00 601/132
2014/0228722 A1 * 8/2014 Nelson ..... A61H 15/0092 601/125

(Continued)

FOREIGN PATENT DOCUMENTS

CN 2399054 10/2000
WO WO-2010019190 A2 * 2/2010 ..... A61H 15/0085

*Primary Examiner* — Kristen Matter
(74) *Attorney, Agent, or Firm* — Manuel de la Cerra

(57) ABSTRACT

A dual muscle roller apparatus is disclosed that includes a crossbeam with first and second ends. A first upright is in rotational connection to the crossbeam first end and a first handle connected at an end of first upright, and a second upright is in rotational connection to the second crossbeam end with a second handle connected at an end of the second upright. A first axle extends away from the first upright, and a first roller is rotationally connected to the axle such that the first roller rotates about the axle. Likewise a second axle extends away from the second upright, and a second roller is rotationally connected to the second axle such that the second roller rotates about the second axle. The first axle and the second axle are separated by a distance that can be adjusted by the placement of the first or second handle.

20 Claims, 14 Drawing Sheets

(56) References Cited

U.S. PATENT DOCUMENTS

2016/0296415 A1* 10/2016 Cross ..... A61H 15/0092
2016/0374893 A1* 12/2016 Johnston ..... A61H 15/00
601/131

* cited by examiner

DUAL MUSCLE ROLLER

RELATED APPLICATIONS

This application claims priority as a non-provisional of U.S. Patent Application 62/210,950 entitled Adjustable Muscle Roller filed on Aug. 27, 2015, and as a non-provisional of U.S. Patent Application 62/376,882 entitled Dual Muscle Roller filed on Aug. 18, 2016. Each of these applications is incorporated in their entirety herein by reference.

TECHNICAL FIELD

The present invention relates to a muscle massager that provides effective therapeutic massage to a user's muscles.

BACKGROUND

Currently two common styles of massage rollers for stretching and massaging a user's legs and other areas of their body are used. Foam rollers as shown in FIGS. 15 and 16 are solid or hollow cylinders of foam or other materials that roll against the ground while the user lies on top of the roller in various positions. The user utilizes gravity to apply pressure between their body and the roller. The user repositions their body to apply pressure to the desired area. The user moves their body back and forth over the roller to provide the rolling motion as the roller rolls against the floor.

Stick rollers as shown in FIGS. 17 and 18 are a second common style of massage roller. They have handles on opposite ends of an axle and contain one or more hollow cylinder segments between the handles that rotate about the axle. They operate similar to a rolling pin used for baking. The user grasps both handles and leans over to apply direct manual pressure of the roller against areas of their body that they can reach. In some cases, the user sits on the floor or on another surface in order to enable them to reach certain areas of their legs.

A wide variety of other specialty rollers are available, but they are currently much less popular than the two main categories of foam roller and stick roller described.

Many users do not like foam rollers because of the need to be on the floor in order to use them. This limits the areas where foam rollers can be used conveniently. They also find that the roller applies either too much pressure or not enough pressure depending on the area of their body and their own body weight. They are not able to control the amount of pressure.

Foam rollers require users to wear tight-fitting clothing in order to avoid tangling their clothes as they roll against the roller and the floor. People that are injured or less physically capable find foam rollers difficult to use because they require significant effort to position and move their body around on the floor and to balance themselves on the roller.

Stick rollers provide improvements over some of the limitations of foam rollers, such as having control over the amount of pressure applied, and avoiding the clothes-tangling problem, but stick rollers have other limiting issues. Users need to bend and twist their bodies in order to be able to reach certain areas of their bodies with the stick roller. It is very difficult and uncomfortable to apply force when bent over or twisted. Users also can't apply enough force with a stick roller, especially when in one of these uncomfortable positions. Users also need to sit on the floor to use the stick roller to reach certain parts of their body. This limits the areas when stick rollers can be used, and requires additional effort for use.

The dual muscle roller describe and claimed herein solves many of the shortcomings of the prior art devices by enabling users to comfortably apply varying amounts of massage pressure against their body. The dual muscle roller can be used while comfortably standing up or sitting down, and requires little to no bending or twisting of the body to reach any area of the user's legs. The dual rollers apply massage to two areas of the user's body at one time, instead of only a single area like the foam roller and stick roller.

The dual muscle roller also enables the user to dynamically vary the amount of pressure applied while rolling. In addition, users are able to apply significantly more pressure than stick rollers due to leverage provided by the position of the lever joint, roller axle, and handle. Because the dual muscle roller is much easier to use while still enabling the user to apply significant massage pressure, users are much more likely to continue using the device when they don't have to struggle with the limitations of a foam roller or stick roller.

SUMMARY

A dual muscle roller apparatus is disclosed and claimed. The apparatus includes a crossbeam with a first end and a second end. A first upright is in rotational connection to the first end of the crossbeam and a first handle connected at an end of first upright, and a second upright is in rotational connection to the second end of the crossbeam and a second handle connected at an end of the second upright. A first roller axle extends away from the first upright, and a first roller is rotationally connected to the first axle such that the first roller rotates about the first roller axle. Likewise a second roller axle extends away from the second upright, and a second roller is rotationally connected to the second axle such that the second roller rotates about the second roller axle. The first roller axle and the second roller axle are separated by a distance and the distance is adjusted by: (a) rotating the first upright about the first rotational connection with the crossbeam; (b) rotating the second upright about the second rotational connection with the crossbeam; or (c) rotating the first upright about the first rotational connection with the crossbeam and rotating the second upright about the second rotational connection with the crossbeam.

In another embodiment the first and second uprights may contain a folding joint. In yet another embodiment, the crossbeam is eliminated and the first and second uprights are in rotational connection with each other.

Various features and improvements may be added to the dual muscle roller apparatus. For example, crossbeam may be comprised of two crossbeam members, and the first handle may curve away from the first upright and the second handle may likewise curve away from the second upright. The first and second uprights may contain a bend. The rotational connection between the first roller axle and the first roller may be detachable such that the first roller can be removed and replaced. The same is true for the second roller axle and second roller. The first or second handles may be constructed as a t-handle or a spherical handle. The rotational connection of the first upright to the first end of the crossbeam may be made using a through-bolt lever joint or a scissor lever joint. The same is true for the connection of the second upright to the second end of the crossbeam.

Methods for using the dual muscle roller apparatus are also disclosed. The user may arrange the pair of uprights on opposing sides of the body part or parts that they want to massage. The user moves the handles together or apart to adjust the space between the rollers. The user applies inward pressure on the handles, which uses lever action to apply proportional pressure from the rollers against their body. The user moves the handles in a cyclic linear motion to move rollers against their body.

The foregoing summary is illustrative only and is not meant to be exhaustive. Other aspects, objects, and advantages of this invention will be apparent to those of skill in the art upon reviewing the drawings, the disclosure, and the appended claims.

BRIEF DESCRIPTION OF THE DRAWINGS

Various aspects of certain example embodiments can be better understood with reference to the following figures. The components shown in the figures are not necessarily to scale, emphasis instead being placed on clearly illustrating example aspects and features. In the figures, like reference numerals designate corresponding parts throughout the different views and embodiments. Certain components and details may be omitted from the figures to improve clarity.

DETAILED DESCRIPTION OF EXAMPLE EMBODIMENTS

Figure 1:
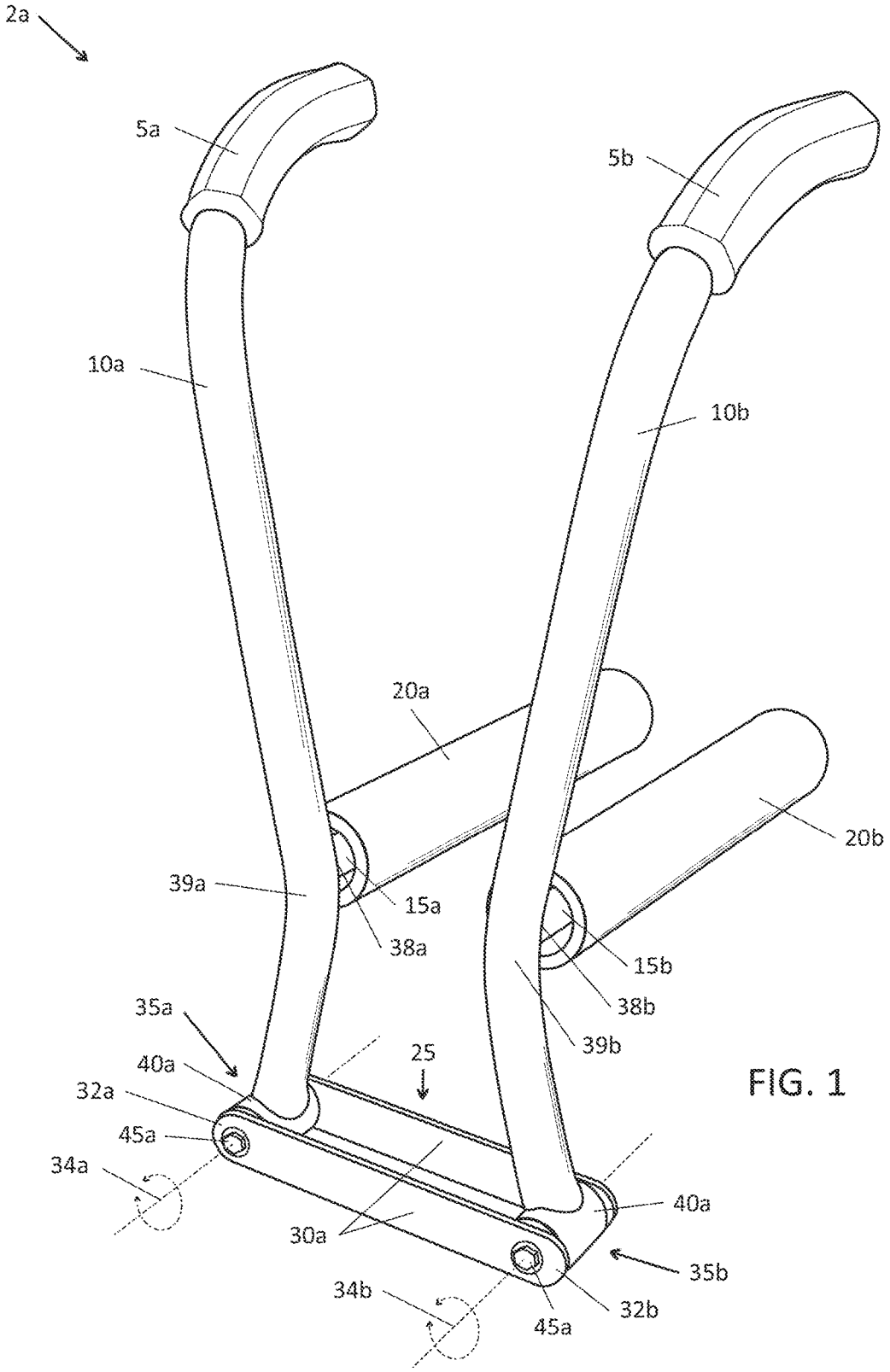
FIG. 1 illustrates a perspective view from the front of a dual muscle roller assembly.

Following is a written description illustrating various aspects of non-limiting example embodiments. These examples are provided to enable a person of ordinary skill in the art to practice the full scope of the invention, including different examples, without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Advantageously, the device and method disclosed herein provide an improved device that allows a user to apply massage to their muscles effectively. FIGS. 1-14 disclose various embodiments of the innovation that provide a device that a user can use to provide effective and therapeutic massage to their muscles. The following list of example features corresponds with FIGS. 1-18 and is provided for ease of reference, where like reference numerals designate corresponding features throughout the specification and figures:

Dual muscle roller first embodiment 2*a*
Dual muscle roller second embodiment 2*b*
Dual muscle roller third embodiment 3
1st/2nd handle 5*a*/5*b*
1st/2nd upright 10*a*/10*b*
1st/2nd upper upright 10*c*/10*d*
1st/2nd lower upright 10*e*/10*f*
1st/2nd roller axle 15*a*/15*b*
Distance between roller axles 16
1st/2nd roller 20*a*/20*b*
Crossbeam assembly 25
Dual crossmembers 30*a*
Single front crossmember 30*b*
1st/2nd crossbeam ends 32*a*/32*b*
1st/2nd rotational planes 33*a*/33*b*
1st/2nd rotational connection 34*a*/34*b*

1st/2nd through-bolt lever joint 35*a*/35*b*
1st/2nd scissor lever joint 36*a*/36*b*
Single lever joint 37
1st/2nd roller axle connection point 38*a*/38*b*
1st/2nd bend angles 39*a*/39*b*
Lever joint cylinder bushing 40*a*
Lever joint angled bushing 40*b*
Lever joint scissor bushing 40*c*
Lever joint axle pin 45*a*
Lever joint axle bolt 45*b*
Single lever joint axle 45*c*
Spring washer 48
1st/2nd folding joint 50*a*/50*b*
1st/2nd rotational joint planes 51*a*/51*b*
Folding joint clamping knob 52
User 60
Foam roller core 100
Foam roller padding 105
Foam roller assembly 110
Stick massager handle 120
Stick massager roller 125
Stick massager roller axle 130
Stick massage roller assembly 135

Figure 11:
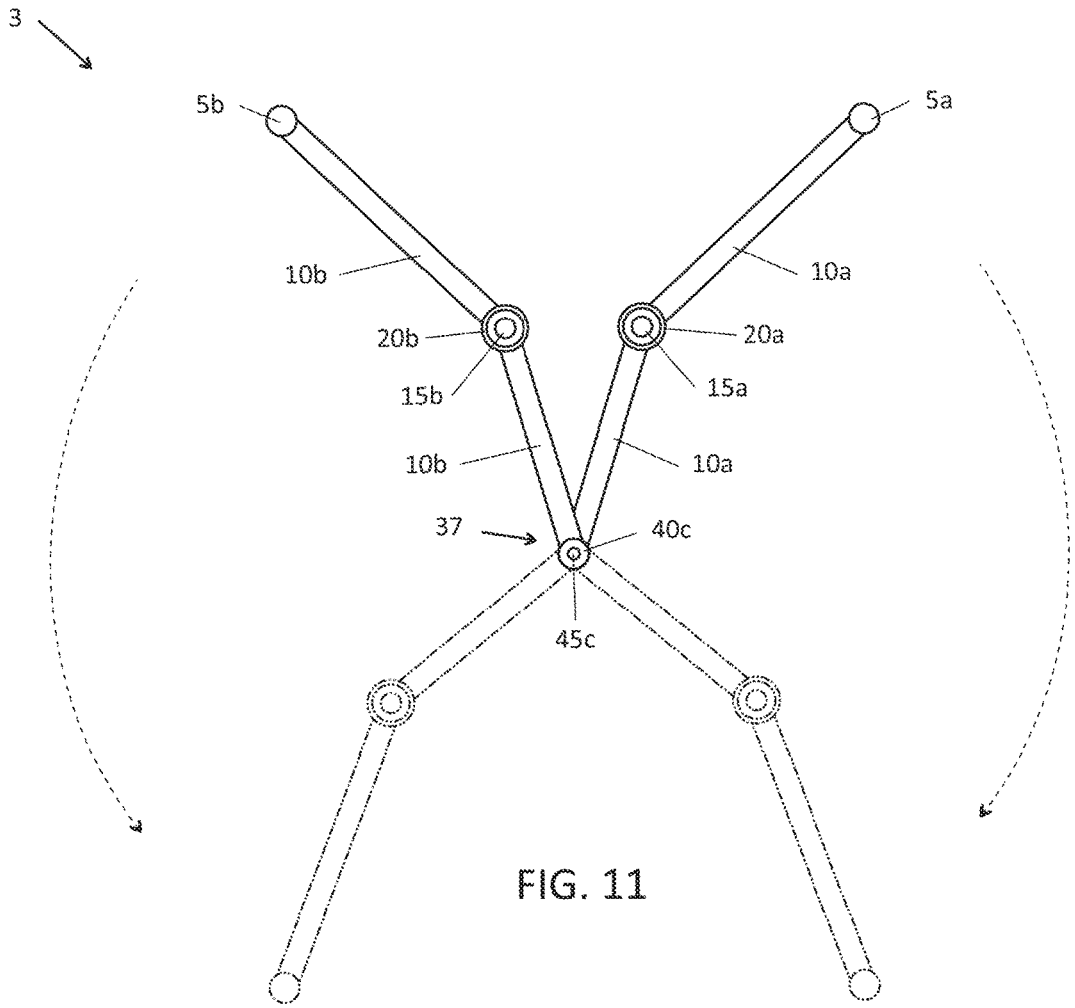
FIG. 11 illustrates a rear view of a dual muscle roller with a single lever joint showing how to convert the device between narrow and wide configuration.
Figure 12:
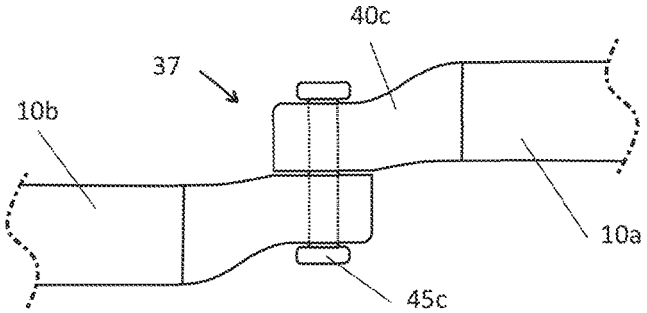
FIG. 12 illustrates a top view of a single lever joint without a crossbeam.
Figure 13:
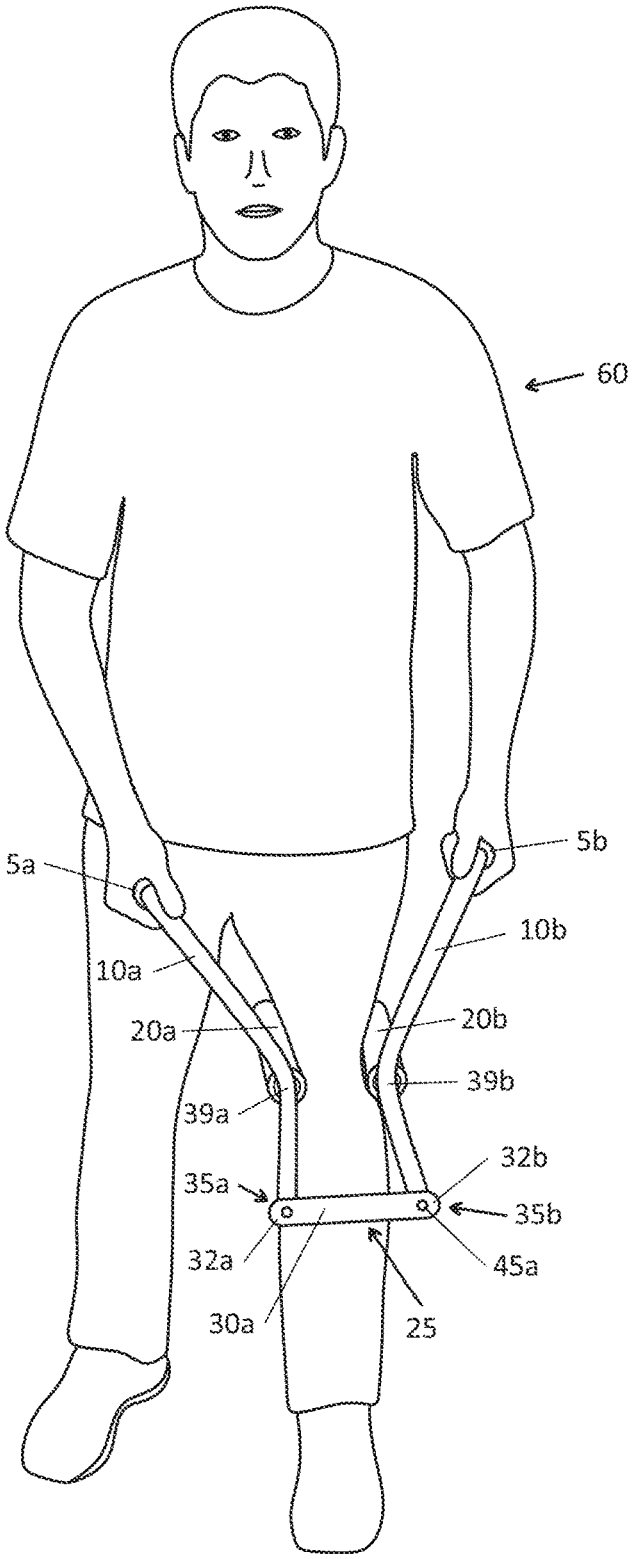
FIG. 13 illustrates a perspective view from the front of a user operating the muscle roller in its narrow configuration around one leg.
Figure 14:
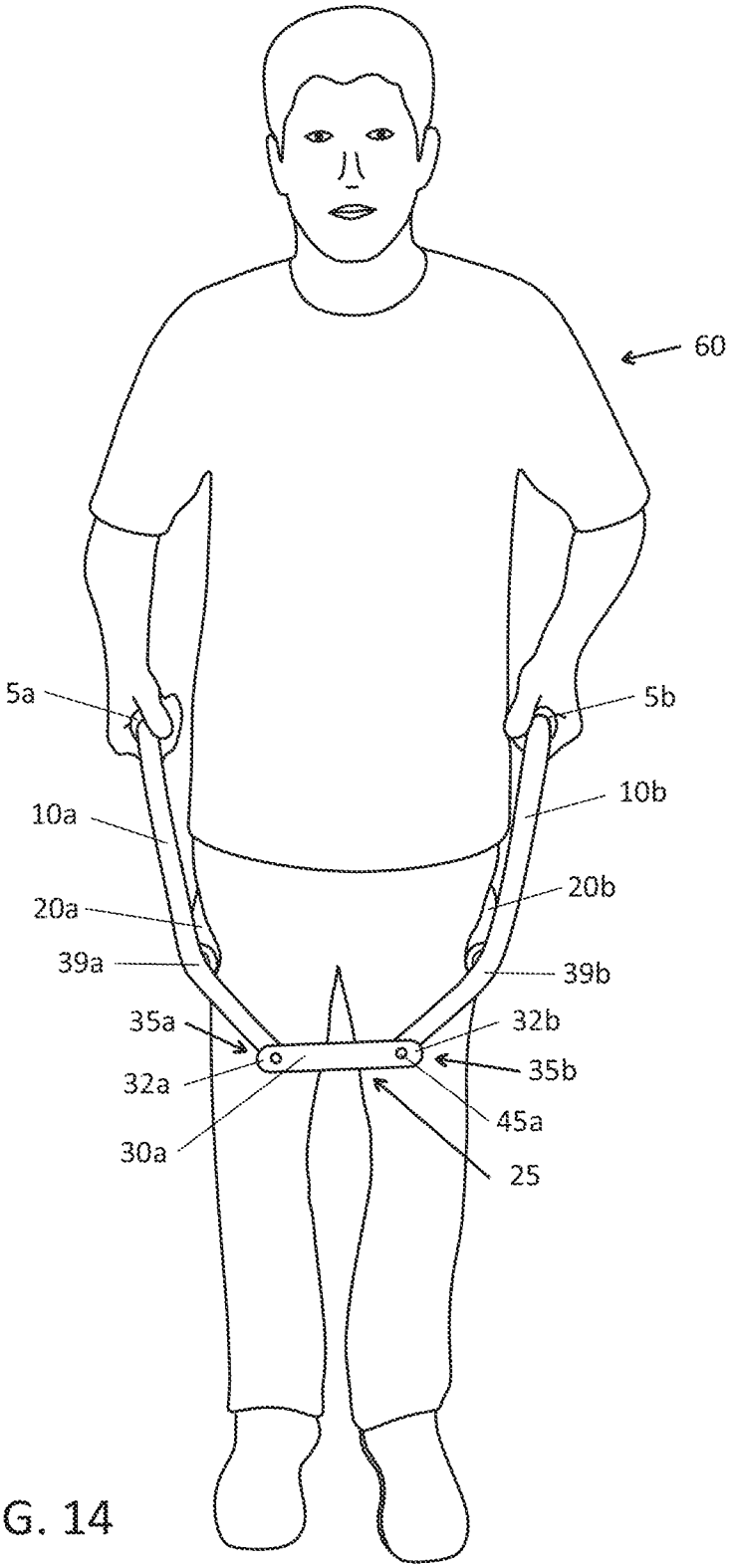
FIG. 14 illustrates a perspective view from the front of a user operating the muscle roller in its wide configuration around two legs.
Figure 15:
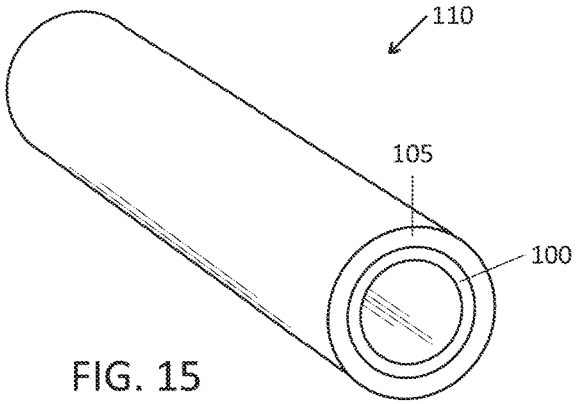
FIG. 15 (Prior art)
FIG. 15 illustrates a prior art roller massage device.
Figure 16:
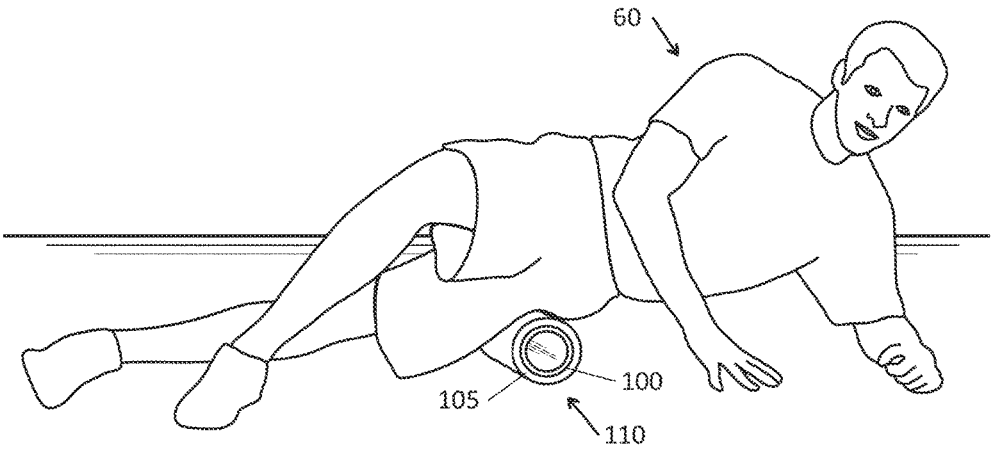
FIG. 16 (Prior art)
FIG. 16 shows the use of the prior art roller massage device of FIG. 15.
Figure 17:
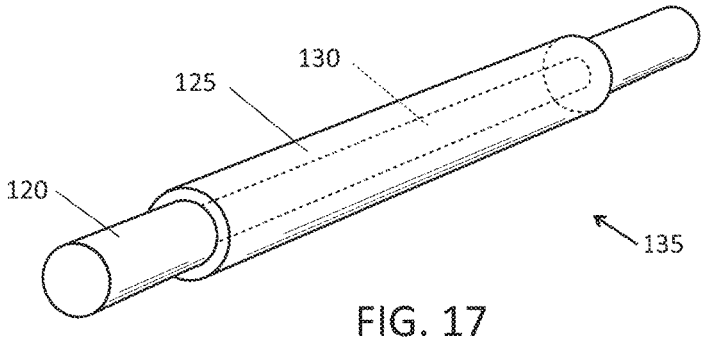
FIG. 17 (Prior art)
FIG. 17 illustrates yet another prior art roller massage device.
Figure 18:
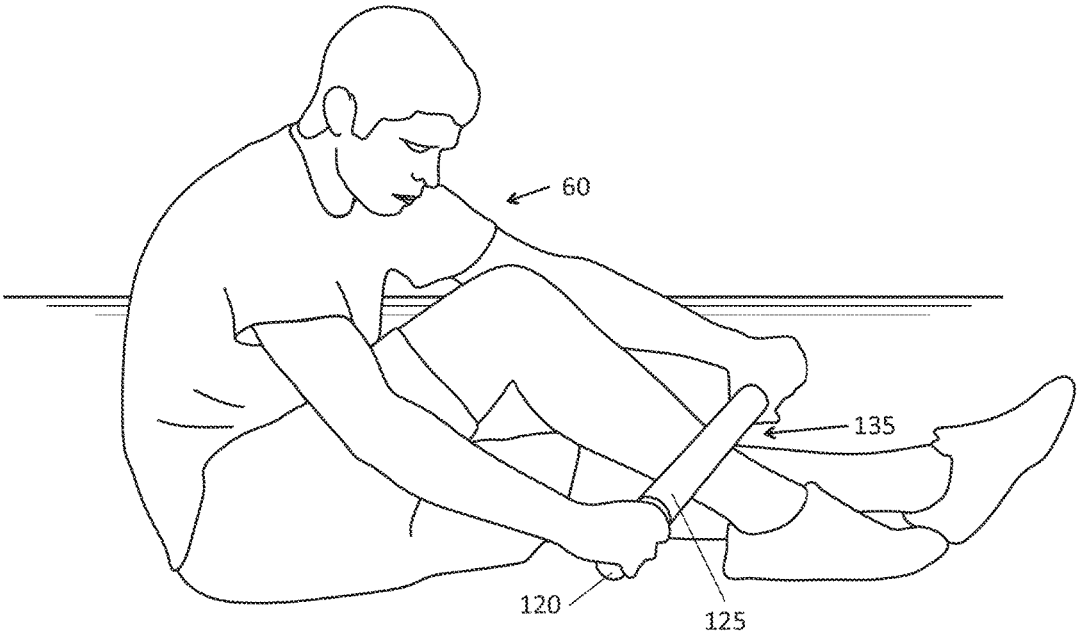
FIG. 18 (Prior art)
FIG. 18 shows the use of the prior art roller massage device of FIG. 17

Now turning to the figures, FIGS. 1-5 illustrate an embodiment of the invention using a dual member crossbeam and a pair of uprights without intermediate folding joints. FIGS. 6-10 illustrate a second embodiment with folding joints, also employing a crossbeam but with only one member. FIGS. 11 and 12 illustrate an embodiment that does not employ a crossbeam, while FIGS. 13 and 14 illustrate how the device is used to massage muscles.

FIGS. 1-5 show a first embodiment of the dual muscle roller 2*a*. The dual muscle roller consists of a crossbeam assembly 25 made up of front and rear crossmembers 30*a*. The crossmembers 30*a* are made of either a solid or hollow rigid material, such as metal, plastic, wood or the like.

A first end 32*a* of the pair of crossmembers 30*a* connects to a first through-bolt lever joint or hinge joint assembly 35*a*. The first lever joint assembly 35*a* is a first rotational connection 34*a*. The through-bolt lever joint assembly 35*a* consists primarily of a lever joint cylinder bushing 40*a* and a lever joint axle pin or bolt 45*a* that passes through the cylinder bushing 40*a*. The bushing 40*a* rotates around the lever joint axle pin 45*a*. The lever joint axle pin 45*a* also passes through a pair of holes in the first end 32*a* of each crossmember 30*a*.

The base of a first upright 10*a* connects to the outside circumference of the lever joint cylinder bushing 40*a* of the first lever joint 35*a*. The upright 10*a* is preferably comprised of a hollow tube made of rigid material such as metal or plastic. The upright 10*a* is preferably welded to the bushing 40*a*.

In the embodiment shown, the top of the first upright 10*a* curves rearward to form a first handle 5*a*. The handle 5*a* is preferably covered with a compliant material such as foam, leather, rubber or the like to provide a comfortable and secure grip.

At a location 38*a* partway along the first upright 10*a* between the handle 5*a* and the lever joint 35*a*, a roller axle 15*a* attaches to a connection point 38*a* at an angle to the upright 10*a* and at an angle to the crossbeam 25. The angle may be 90 degrees, such that it is perpendicular, but other embodiments could include a lesser angle, preferably greater than 45 degrees because anything less than that would likely cause the upright 10*a* to interfere with the roller axle 15*a*. In one embodiment, the handle 5*a* is parallel to the axis of the roller axle 15*a* and parallel to the axis of the lever joint axle pin 45*a*. The roller axle 15*a* is a rigid hollow or solid tube comprised of metal, plastic, wood or the like.

A roller 20*a* surrounds the roller axle 15*a*. The roller 20*a* is comprised of one or more hollow cylinders or tubes that fit around the roller axle 15*a*. The roller cylinder 20*a* is made of a rigid material such as plastic, metal, or wood. In one embodiment, the roller's 20*a* outer surface is covered with a padding material such as foam, leather, rubber or the like. In one embodiment, the roller 20*a* includes one or more internal bearings or bushings that allow the roller 20*a* to rotate freely about the roller axle 15*a*. In one embodiment, the rotational connection between the first roller axle 15*a* and the first roller 20*a* may be detachable such that the first roller 20*a* can be removed and replaced. This allows the user to select another roller with a different diameter, firmness, surface texture, or surface contour.

In one embodiment, the first upright 10*a* contains a bend or angled section 39*a* from its base to the connection point 38*a* of the roller axle 15*a*. The bend 39*a* is such that the handle 5*a*, roller axle 15*a*, and lever joint 35*a* are not collinear when viewed from the rear of the device, as in FIG. 4. It is understood that this can also be achieved with straight upper and lower upright 10*a* segments that meet at an angle where the roller axle 15*a* intersects the upright 10*a* at the axle intersection point 38*a*.

A second upright 10*b* is comprised of a second lever joint 35*b*, a second bend angle 39*b*, a second connection point 38*b*, a second roller axle 15*b*, a second roller 20*b*, and a second handle 5*b*. The second upright 10*b* is a mirror image of the first upright 10*a*, with the curved portion of the upright 39*b* curving in the opposite direction from the curved portion 39*a* of the first upright.

Figure 2:
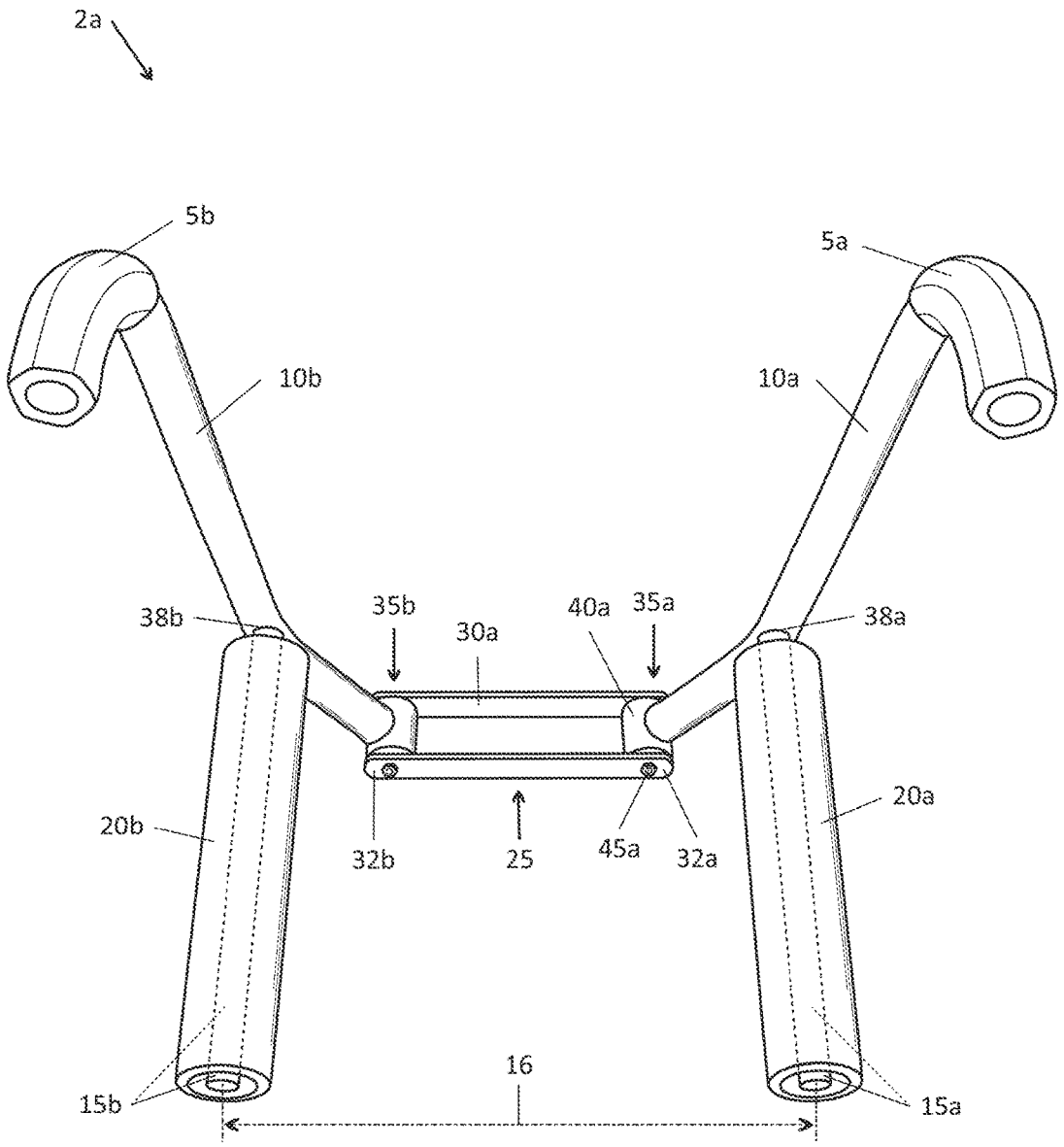
FIG. 2 illustrates a perspective view from the rear of the dual muscle roller assembly.
Figure 3:
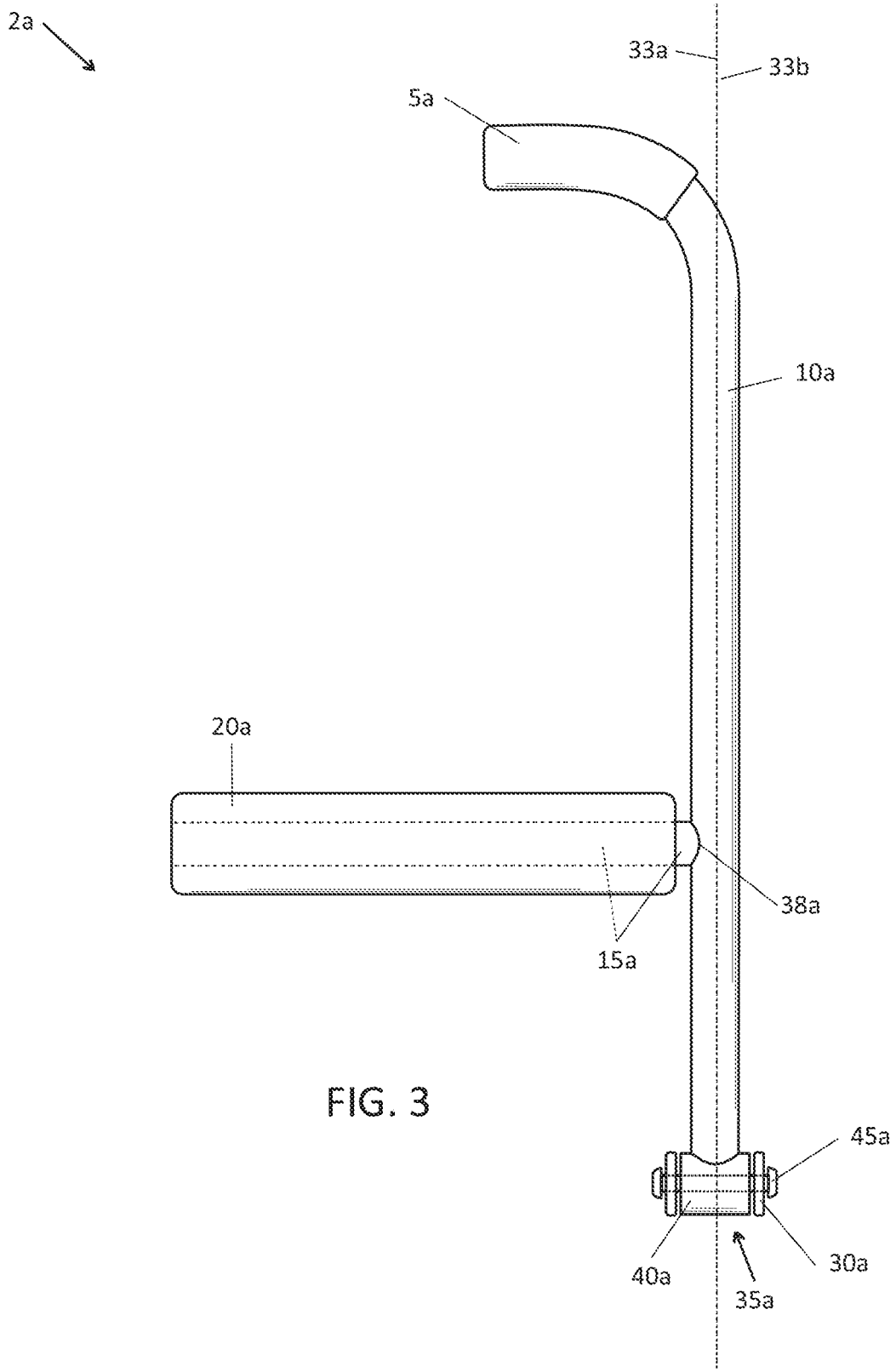
FIG. 3 illustrates a side view of the dual muscle roller assembly.
Figure 4:
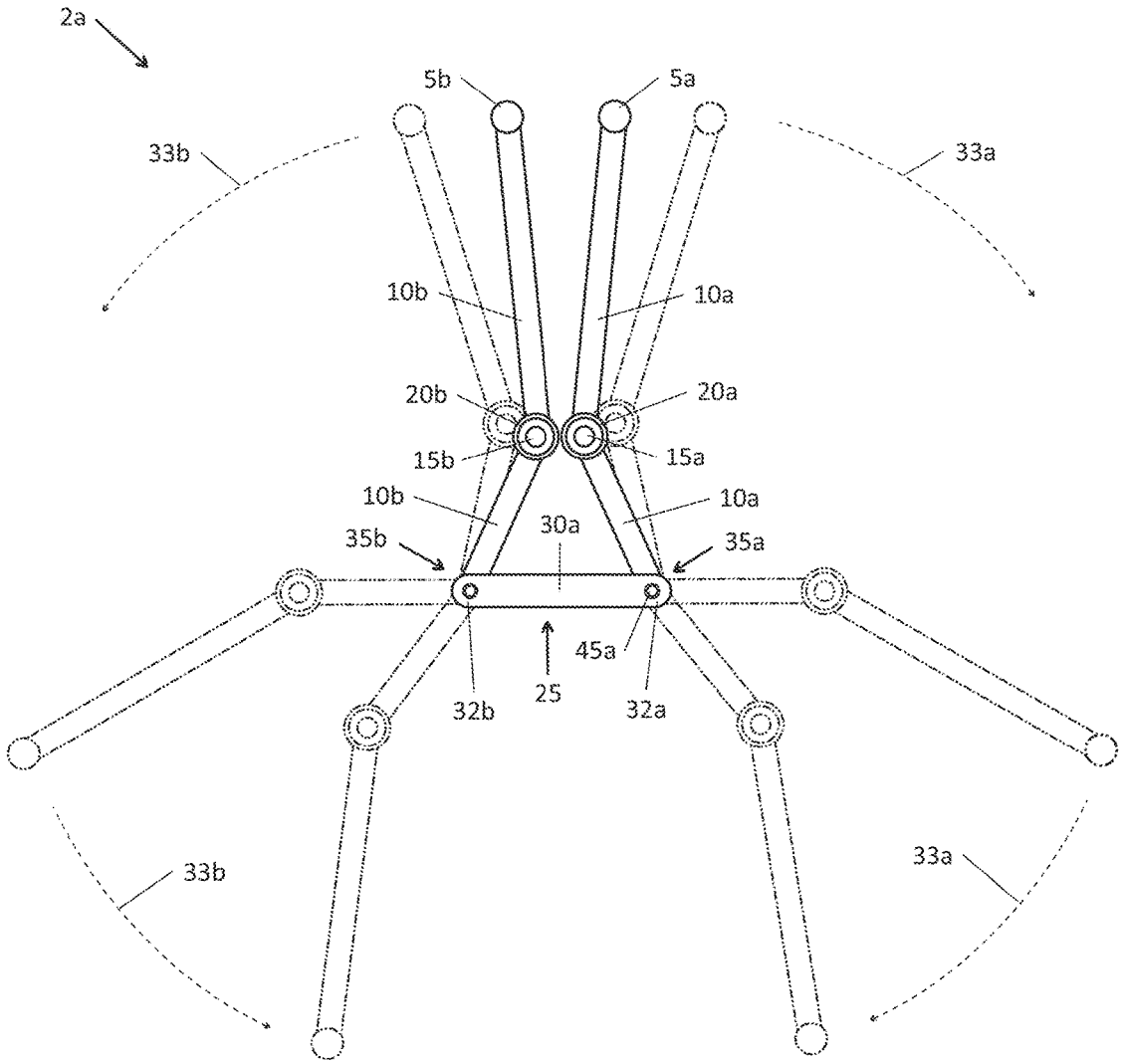
FIG. 4 illustrates a rear view of a dual muscle roller assembly showing how to convert the device between narrow and wide configuration.
Figure 5:
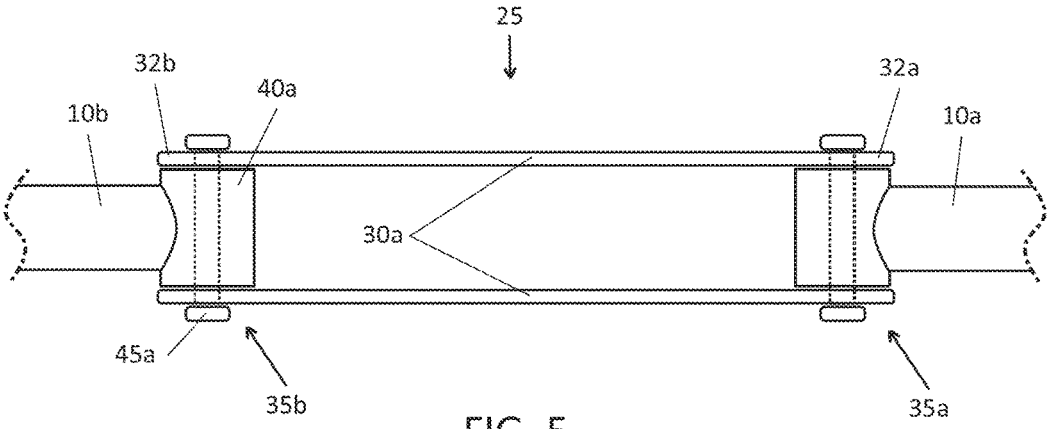
FIG. 5 illustrates a top view of a crossbeam assembly with front and rear crossmembers.
Figure 6:
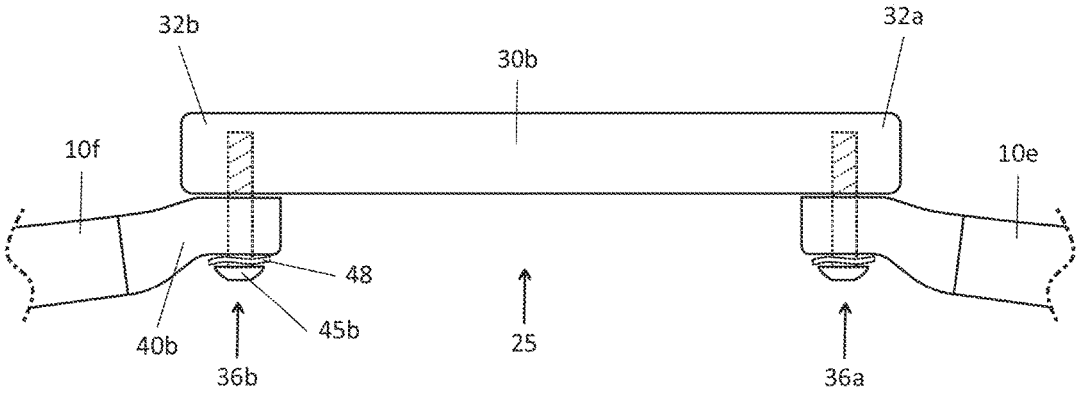
FIG. 6 illustrates a top view of a crossbeam assembly with a front crossmember connecting two scissor-style lever joints.

FIGS. 1 and 4 show the dual muscle roller 2*a* in the narrow configuration, where the first and second uprights 10*a*, 10*b* curve toward each other at the bend location 39*a*, 39*b* between the handles 5*a*, 5*b* and the base of each upright. FIG. 2 shows the muscle roller in the wide configuration, where the uprights 10*a*, 10*b* curve away from each other. For a given spacing between the two handles 5*a*, 5*b*, the separation distance 16 between the first and second roller axles 15*a*, 15*b* is smaller in the narrow configuration compared to the wide configuration.

FIG. 4 illustrates the transition between narrow to wide configuration. The solid lines in FIG. 4 show the dual muscle roller 2*a* in its narrowest configuration, with the first and second rollers 20*a*, 20*b* touching. As the first and second handles 5*a*, 5*b* rotate away from each other, the first set of dashed figure lines show the dual muscle roller in its normal use narrow configuration. The next set of dashed figure lines show the dual muscle roller in its widest possible configuration, where the first and second rollers 20*a*, 20*b* are as far apart from each other as possible. The final set of dashed figure lines show the dual muscle roller in its normal use wide configuration. This is the same as the wide configuration shown in FIG. 2, but turned upside down. In FIG. 4, when the first and second handles 5*a*, 5*b* are above the first and second rollers 20*a*, 20*b*, the dual muscle roller is in the narrow configuration. When the handles 5*a*, 5*b* are below the rollers 20*a*, 20*b* in the FIG. 4, the dual muscle roller is in the wide configuration.

Now the operation of the first embodiment shown in FIGS. 1-5 will be detailed. Referring to FIGS. 13-14, a user 60 picks up the dual muscle roller 2*a* by grasping the first handle 5*a* in their right hand and the second handle 5*b* in their left hand such that the dual muscle roller assembly 2*a* is in front of the user's body. Thus, the handles 5*a*, 5*b* curve back toward the user and the crossbeam 25 is in front with the roller axles 15*a*, 15*b* pointing rearward towards the user 60.

The user 60 adjusts the muscle roller to either its narrow configuration (FIGS. 1, 13) or wide configuration (FIGS. 2, 14). To do this, the user applies force on handles 5*a*, 5*b* to rotate the uprights 10*a*, 10*b* about the lever joints 35*a*, 35*b*. The first lever joint assembly 35*a* is a first rotational connection 34*a* that allows the first upright 10*a* to rotate in the first rotational plane 33*a*. The second lever joint assembly 35*b* is a second rotational connection 34*b* that allows the second upright 10*b* to rotate in the second rotational plane 33*b*. In one embodiment, the first rotational plane 33*a* and second rotational plane 33*b* are coplanar.

When the user brings both handles 5*a*, 5*b* together, if the rollers 20*a*, 20*b* are touching, then the dual muscle roller is in the narrow configuration. If the rollers 20*a*, 20*b* are separated while the handles 5*a*, 5*b* are touching, then the dual muscle roller is in the wide configuration. To switch from one configuration to the other configuration, the user rotates handles 5*a*, 5*b* approximately 180 degrees away from each other about their respective lever joints 35*a*, 35*b* keeping the crossbeam 25 stationary. If the handles 5*a*, 5*b* are facing down after the configuration change, the user rotates the entire dual muscle roller assembly 2*a* by 180 degrees in the rotational plane 33*a* until both handles 5*a*, 5*b* are on top. In this way, the user can convert the device between two different operating configurations in less than five seconds without any tools, pins, knobs, or the like.

The user then arranges the pair of rollers 20*a*, 20*b* on opposing sides of the body part or parts that they want to massage (FIGS. 13-14). The user moves the handles 5*a*, 5*b* together or apart to adjust the space between the rollers 20*a*, 20*b*.

Once both rollers 20*a*, 20*b* touch the user's 60 body, the user applies inward force on the outside of the handles 5*a*, 5*b*. This action applies pressure from the rollers 20*a*, 20*b* against the user's 60 body using leverage between the handles 5*a*, 5*b*, rollers 20*a*, 20*b*, and lever joints 35*a*, 35*b*. The amount of pressure that the rollers 20*a*, 20*b* apply to the user's 60 body is proportional to the amount of inward force the user 60 applies to the handles 5*a*, 5*b*.

The user 60 then moves the handles 5*a*, 5*b* up and down in a reciprocating linear motion to roll the rollers 20*a*, 20*b* against the desired region of their body. The user 60 adjusts the inward pressure against the handles 5*a*, 5*b* as desired while the rollers 20*a*, 20*b* travel across different areas of the user's 60 body.

The user 60 then transforms the dual muscle roller 2*a* to the opposite configuration (narrow vs. wide) by rotating the first handle 5*a* in the user's 60 right hand approximately 180 degrees clockwise about its respective lever joint 35*a* and rotating the second handle 5*b* in the user's left hand approximately 180 degrees counter-clockwise about its respective lever joint 35*b*. This leaves the dual muscle roller 2*a* in the new (opposite) configuration, but temporarily oriented upside-down (handles 5*a*, 5*b* at the bottom). The user simply rotates the whole assembly 2*a* by approximately 180 degrees so that the handles 5*a*, 5*b* are at the top. The structure disclosed herein is adapted to rotate approximately 180 degrees to convert from the wide to the narrow configuration, however, it would be apparent to one of skill in the art that the design could be modified such that the rotation is less than 180 degrees. Also, the rotation may be less than 180 degrees depending on where the user 60 of the dual muscle roller 2*a* begins prior to converting the configuration.

The user 60 repeats the same actions as before to make minor adjustments to the separation 16 of the roller axles 15*a*, 15*b* by rotating the handles 5*a*, 5*b* about their respective lever joints 35*a*, 35*b*. The user then applies inward pressure on the handles 5*a*, 5*b* to perform the massaging action on their body.

FIGS. 6-10 show another embodiment of the dual muscle roller 2*b*. This embodiment 2*b* shares a similar basic structure and operation as the first embodiment 2*a*, but this alternate embodiment includes some changes and additions.

The dual muscle roller 2*b* shown in FIGS. 6-10 consists of a crossbeam assembly 25 made up of a single front crossmember 30*b*. The crossmember 30*b* is made of either a solid or hollow rigid material, such as metal, plastic, wood or the like.

In one embodiment, a first scissor-style lever joint or hinge joint 36*a* connects to the crossmember 30*b* at a first end 32*a*. The first scissor-style lever joint 36*a* includes an angled lever joint bushing 40*b* and a lever joint axle pin or bolt 45*b*, both preferably constructed of metal. The lever joint axle bolt 45*b* passes through a hole in the angled lever joint bushing 40*b* and secures to the crossmember 30*b* at the first end 32*a*. The lever joint bushing 40*b* rotates about the lever joint axle bolt 45*b*. The lever joint axle bushing 40*b* has a flat surface that bears against a corresponding flat surface of the crossmember 30*b*. The scissor-style lever joint 36*a* optionally includes a spring washer 48 or the like to create pressure between the bushing 40*b* and crossmember 30*b* bearing surfaces.

The angled lever joint axle bushing 40*b* connects to a first lower upright 10*e*. In one embodiment, the first lower upright 10*e* is welded to the lever joint bushing 40*b*. The first lower upright 10*e* connects the first lever joint 36*a* at its bottom end to a first folding joint or hinge joint 50*a* at its top end.

Partway along the first lower upright 10*e* between the first folding joint 50*a* and the first lever joint 36*a*, a first roller axle 15*a* attaches to a connection point 38*a* at an angle to the lower upright 10*e* and at an angle to the crossmember 30*b*. The angle may be 90 degrees, such that it is perpendicular, but other embodiments could include a lesser angle, preferably greater than 45 degrees In one embodiment, the axis of the roller axle 15*a* is parallel to the axis of the lever joint axle bolt 45*b*. The roller axle 15*a* is a rigid hollow or solid tube comprised of metal, plastic, wood or the like.

A first roller 20*a* surrounds the first roller axle 15*a*. The roller 20*a* is comprised of one or more hollow cylinders or tubes that fit around the roller axle 15*a*. The roller cylinder 20*a* is made of a rigid material such as plastic, metal, or wood. In one embodiment, the roller's 20*a* outer surface is covered with a padding material such as foam, leather, rubber or the like. In one embodiment, the roller 20*a* includes one or more internal bearings or bushings that allow the roller 20*a* to rotate freely about the roller axle 15*a*.

Figure 9:
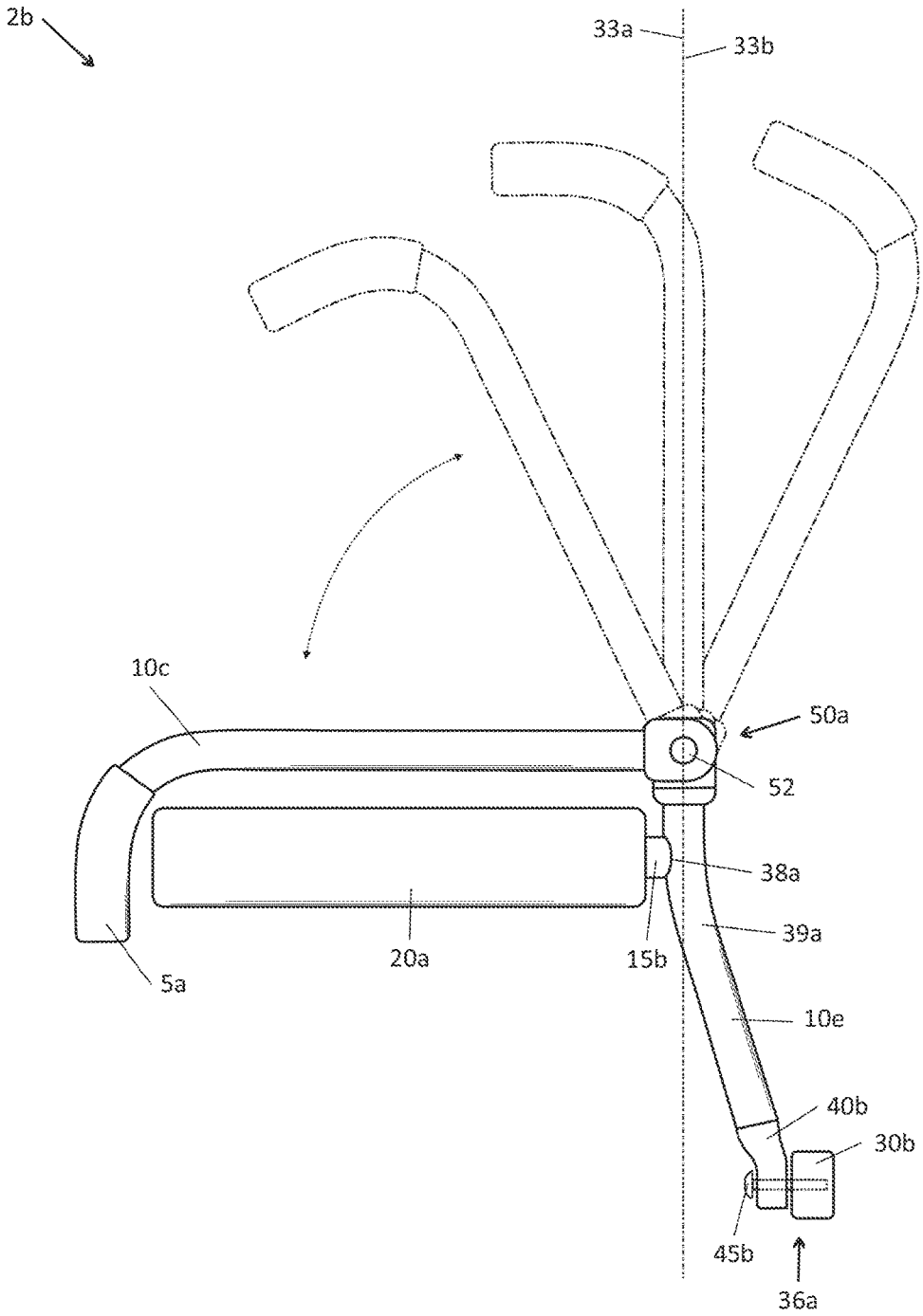
FIG. 9 illustrates a side view of the dual muscle roller assembly with folding joints, where the upper uprights are folded rearward.

FIG. 9 shows a side view of the dual muscle roller assembly 2*b*, where the first lower upright 10*e* includes a bend or curved section 39*a* that bends away from the crossmember 30*b* instead of proceeding parallel to the rotational plane 33*a* towards the first roller axle connection-point 38*a* as in the first embodiment 2*a*. The single front crossmember 30*b* along with the angled lower upright 10*e* create additional clearance between the crossmember 30*b* and the user's 60 body compared to the first embodiment.

Figure 8:
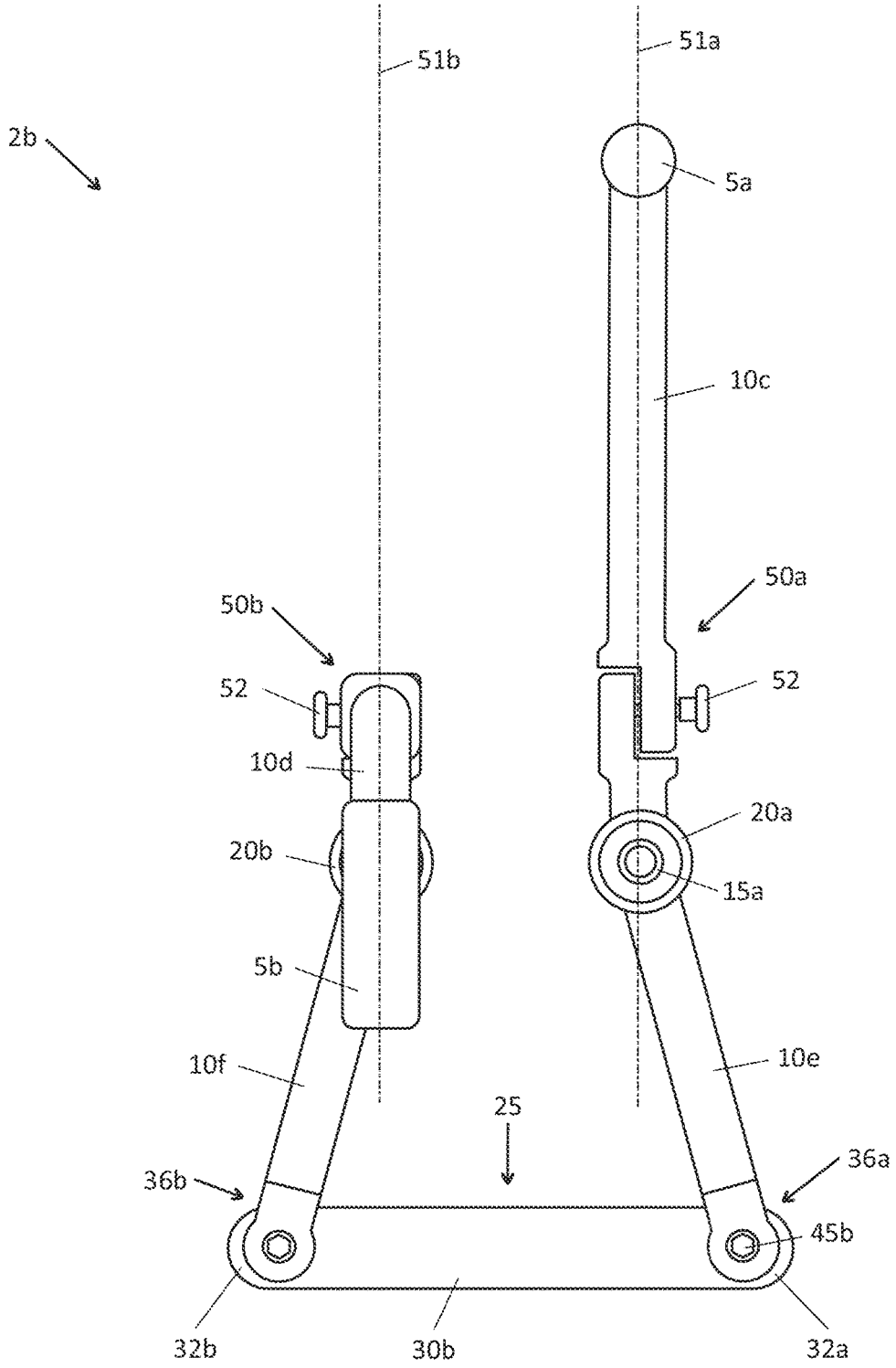
FIG. 8 illustrates a rear view of the dual muscle roller assembly with folding joints, where the left upper upright is folded rearward.

FIG. 8 shows that the lower upright 10*e* additionally bends to the side, similar to the first embodiment. The first lower upright 10*e* is a mirror image of a second lower upright 10*f*.

The top of the first lower upright 10*e* connects to the first folding joint 50*a*. In one embodiment, the first lower upright 10*e* is a metal tube that is welded to a metal folding joint 50*a*. A first upper upright 10*c* connects to the top of the first folding joint 50*a*. The top of the first upper upright 10*c* curves rearward to form a first handle 5*a*, as in the first embodiment.

Figure 7:
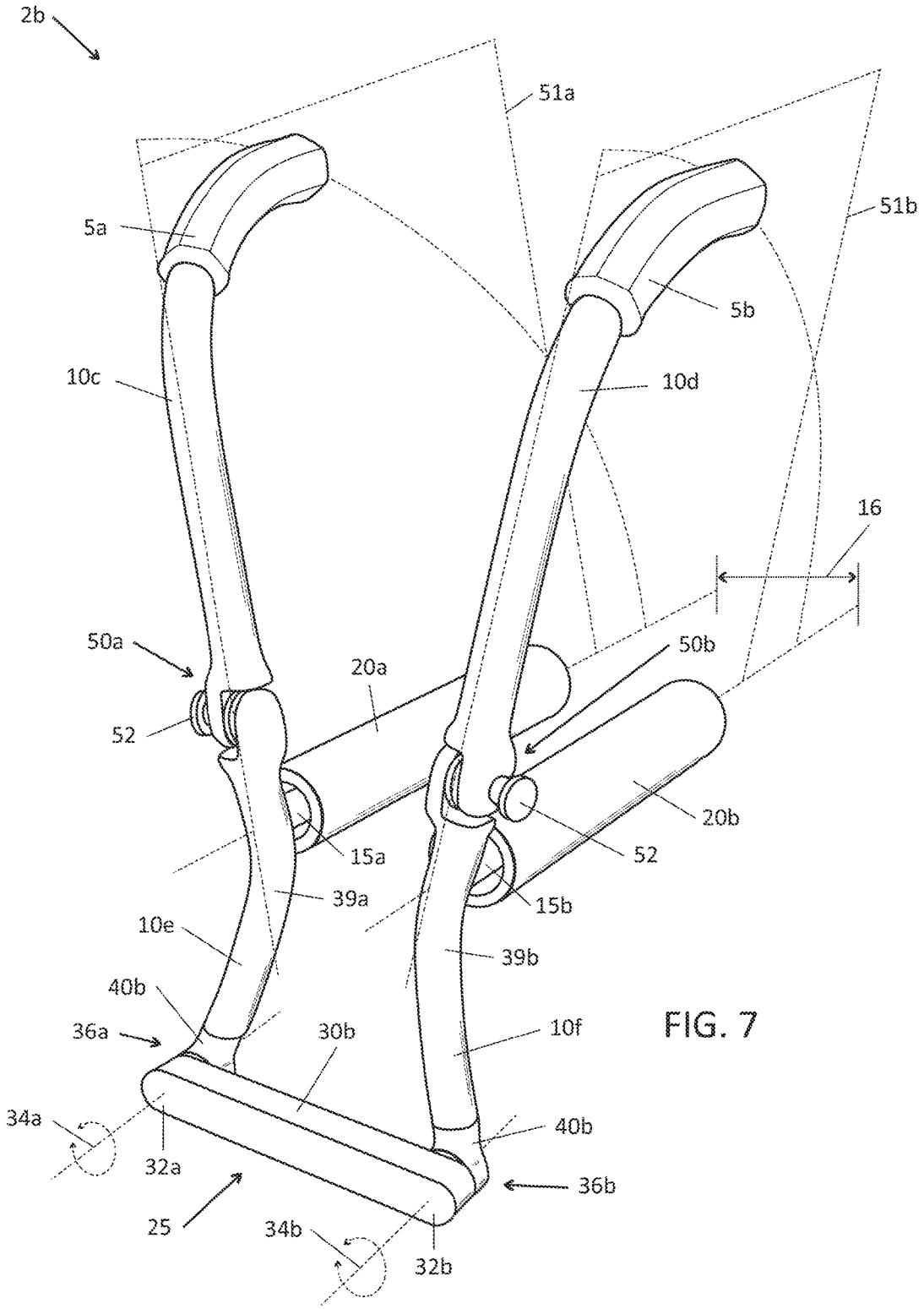
FIG. 7 illustrates a perspective view from the front of a dual muscle roller assembly with folding joints.

In the embodiment shown, the first folding joint 50*a* is located between the first roller axle connection-point 38*a* and the first handle 5*a* along the upright. In another embodiment, the folding joint 50*a* is located anywhere along the upright between the handle 5*a* and the lever joint 36*a*. In one embodiment, the folding joint 50*a* is a locking joint that can lock into one or more orientations. In the embodiment from FIGS. 6-10, the folding joint 50*a* includes a clamping knob 52. The folding joint 50*a* pivots about the axle of the bolt connected to the clamping knob 52. The folding joint 50*a* allows the upper upright 10*c* to angle forward and backward as shown in FIGS. 7-9.

The first handle 5*a*, first upper upright 10*c*, first folding joint 50*a*, first roller axle 15*a*, first roller 20*a*, first lower upright 10*e*, and first lever joint 36*a* connect through the single front crossmember 30*b* to a second assembly that is a mirror image of the first assembly. The second assembly contains a second lever joint 36*b*, second lower upright 10*f*, second roller axle 15*b*, second roller axle connection point 38*b*, second roller 20*b*, second folding joint 50*b*, second upper upright 10*d*, and second handle 5*b*. The second lower upright 10*f* is a mirror image of the first lower upright 10*e*, with the sideways curving portion of the upright 39*b* curving in the opposite direction.

Figure 10:
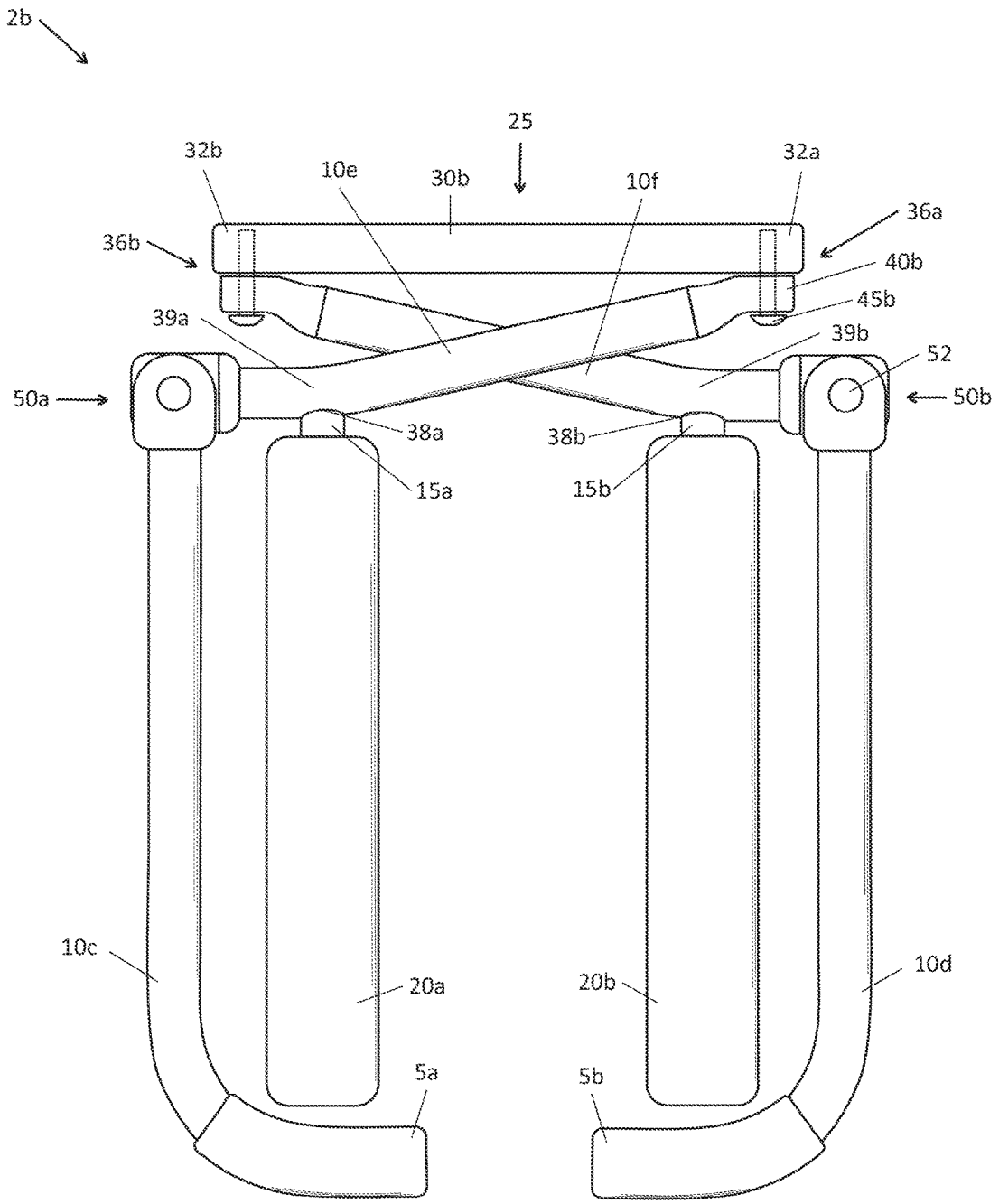
FIG. 10 illustrates a top view of the dual muscle roller assembly with folding joints in a completely folded configuration.

FIG. 10 shows a top view of the dual muscle roller 2*b* in a completely folded arrangement. When folded, the upper uprights 10*c*, 10*d* are parallel with both rollers 20*a*, 20*b* and both roller axles 15*a*, 15*b*. The lower uprights 10*e*, 10*f* are crossed and contacting each other along their length. The lower uprights 10*e*, 10*f* are substantially in the same horizontal plane as the crossmember 30*b* and the rollers 20*a*, 20*b* and the upper uprights 10*c*, 10*d*. The bends 39*a*, 39*b* in the lower uprights 10*e*, 10*f* along with the single front crossmember 30*b* in this embodiment allow the lower uprights to fold more compactly. This arrangement avoids interference between the lower uprights 10*e*, 10*f* and the lever joints 36*a*, 36*b*. The arrangement of this embodiment of the dual muscle roller 2*b* lacking a rear crossmember also avoids contact between the lower uprights 10*e*, 10*f* and the rear crossmember 30*a* from FIGS. 1, 2, 5 of the first embodiment 2*a*.

Now the operation of the dual muscle roller embodiment 2*b* in FIGS. 6-10 will be detailed. The operation of this second embodiment of the dual muscle roller 2*b* is very similar to the first embodiment 2*a*. Although FIGS. 13-14 illustrate the operation of the first embodiment, these figures can also be referenced because the operation of the first and second embodiments is very similar. A user 60 picks up the dual muscle roller 2*b* by grasping the first handle 5*a* in their right hand and the second handle 5*b* in their left hand such that the dual muscle roller assembly 2*b* is in front of the user's 60 body. Thus, the handles 5*a*, 5*b* curve back toward the user 60 and the crossbeam 25 is in front with the roller axles 15*a*, 15*b* pointing rearward towards the user 60.

The user 60 adjusts the muscle roller to either its narrow configuration (FIGS. 1, 13) or wide configuration (FIGS. 2, 14). To do this, the user 60 applies force on handles 5*a*, 5*b* to rotate the lower uprights 10*e*, 10*f* about their respective lever joints 36*a*, 36*b*. The first lever joint assembly 36*a* is a first rotational connection 34*a* that allows the first upper upright 10*c* to rotate in the first rotational plane 33*a*. The second lever joint assembly 36*b* is a second rotational connection 34*b* that allows the second upper upright 10*d* to rotate in the second rotational plane 33*b*. In one embodiment, the first rotational plane 33*a* and second rotational plane 33*b* are coplanar.

When the user 60 brings both handles 5*a*, 5*b* together, if the rollers 20*a*, 20*b* are touching, then the dual muscle roller is in the narrow configuration. If the rollers 20*a*, 20*b* are separated while the handles 5*a*, 5*b* are touching, then the dual muscle roller is in the wide configuration. To switch from one configuration to the other configuration, the user 60 rotates handles 5*a*, 5*b* approximately 180 degrees away from each other about their respective lever joints 36*a*, 36*b* keeping the crossbeam 25 stationary. If the handles 5*a*, 5*b* are facing down after the configuration change, the user 60 rotates the entire dual muscle roller assembly 2*b* by 180 degrees in the rotational plane 33*a* until both handles 5*a*, 5*b* are on top.

The user 60 then arranges the pair of rollers 20*a*, 20*b* on opposing sides of the body part or parts that they want to massage (FIGS. 13, 14). The user 60 moves the handles 5*a*, 5*b* together or apart to adjust the space between the rollers 20*a*, 20*b*.

Once both rollers 20*a*, 20*b* touch the user's 60 body, the user 60 applies inward force on the outside of the handles 5*a*, 5*b*. This action applies pressure from the rollers 20*a*, 20*b* against the user's 60 body using leverage between the handles 5*a*, 5*b*, rollers 20*a*, 20*b*, and lever joints 36*a*, 36*b*. The amount of pressure that the rollers 20*a*, 20*b* apply to the user's 60 body is proportional to the amount of inward force the user 60 applies to the handles 5*a*, 5*b*.

The user 60 then moves the handles 5*a*, 5*b* up and down in a reciprocating linear motion to roll the rollers 20*a*, 20*b* against the desired region of their body. The user 60 adjusts the inward pressure against the handles 5*a*, 5*b* as desired as the rollers 20*a*, 20*b* travel across different areas of the user's 60 body.

The user 60 then transforms the dual muscle roller 2*b* to the opposite configuration (narrow vs. wide) by rotating the first handle 5*a* in the user's right hand approximately 180 degrees clockwise about its respective lever joint 36*a* and rotating the second handle 5*b* in the user's left hand approximately 180 degrees counter-clockwise about its respective lever joint 36*b*. This leaves the dual muscle roller 2*b* in the new (opposite) configuration, but temporarily oriented upside-down (handles 5*a*, 5*b* at the bottom). The user 60 simply rotates the whole assembly 2*b* by 180 degrees in the rotational plane 33*a* so that the handles 5*a*, 5*b* are at the top.

The user 60 repeats the same actions as before to make minor adjustments to the separation 16 of the roller axles 15*a*, 15*b* by rotating the handles 5*a*, 5*b* about their respective lever joints 36*a*, 36*b*. The user 60 then applies inward pressure on the handles 5*a*, 5*b* to perform the massaging action on their body.

To fold the muscle roller for compact transport, the user 60 first loosens the clamping knobs 52 on each folding joint 50*a*, 50*b*. This unlocks the folding joints 50*a*, 50*b* allowing them to rotate. The user 60 then rotates each upper upright 10*c*, 10*d* rearward until they are parallel with their respective roller axles 15*a*, 15*b*. Upright 10*c* rotates about folding joint 50*a* in plane 51*a*. Upright 10*d* rotates about folding joint 50*b* in plane 51*b*. The user 60 tightens both clamping knobs 52 to lock the folding joints 50*a*, 50*b* and to keep the upper uprights 10*c*, 10*d* in their folded orientation. The user 60 then holds the crossbeam 25 stable while rotating both lower uprights 10*e*, 10*f* in the same direction (both clockwise or both counter-clockwise) about their respective lever joints 36*a*, 36*b*. The user 60 rotates the lower uprights 10*e*, 10*f* until they touch and are substantially on the same plane as the crossbeam 25 as shown in FIG. 10. The upper uprights 10*c*, 10*d* are also substantially on the same plane as the roller axles 15*a*, 15*b*, the lower uprights 10*e*, 10*f*, and the single crossmember 30*b* once the muscle roller assembly 2*b* is completely folded as in FIG. 10.

To unfold the dual muscle roller assembly 2*b*, the user 60 rotates the lower uprights 10*e*, 10*f* away from each other. While keeping the crossbeam 25 fixed, the user 60 rotates the first lower upright 10*e* by 90 degrees about its respective lever joint 36*a*. The user 60 rotates the second lower uprights 10*f* by 270 degrees. This leaves the top of both lower uprights 10*e*, 10*f* pointing in the same direction. The user 60 then loosens the clamping knobs 52 on each folding joint 50*a*, 50*b*. The user 60 then rotates each upper upright 10*c*, 10*d* until they are preferably perpendicular with their respective roller axle 15*a*, 15*b*. The user 60 tightens both clamping knobs 52 to lock the folding joints 50*a*, 50*b* in place and to keep the upper uprights 10*c*, 10*d* in their unfolded orientation.

FIGS. 11 and 12 show yet another embodiment of the dual muscle roller 3. In this embodiment, the crossmembers 30*a* from the first embodiment in FIGS. 1-5 are eliminated, leaving only a single lever joint assembly 37. Lever joint bushings 40*c* are connected to the base of each upright 10*a*, 10*b* and share a single lever joint axle, pin, or bolt 45*c* in the embodiment from FIGS. 11-12. The single lever joint axle 45*c* passes through the center of the lever joint bushings 40*c*, linking both uprights 10*a*, 10*b* together and allowing them to pivot about the single lever joint axle 45*c*.

In the embodiment shown in FIG. 11, the length of the uprights 10*a*, 10*b*, the angle of the bends 39*a*, 39*b* in the uprights, and the placements 38*a*, 38*b* of the roller axles 15*a*, 15*b* along the upright are different from the first embodiment of the dual muscle roller shown in FIGS. 1-5. The differences in these measurements are to maintain a similar ratio of the space between handles 5*a*, 5*b* and the space 16 between the roller axles 15*a*, 15*b* when in narrow and wide configuration.

In another embodiment that includes a single lever joint 37, the length of the upright 10*a*, the angle of the bend in the upright 39*a*, and the placement of the roller axle 15*a* along the upright 10*a* are the same as the first embodiment of the dual muscle roller 2*a* shown in FIGS. 1-5.

In one embodiment, the lever joint bushing 40*c*, first roller axle connection-point 38*a*, and first handle 5*a* are all collinear along the first upright 10*a*.

In another embodiment shown in FIG. 11, the lever joint bushing 40*c*, first roller axle connection-point 38*a*, and first handle 5*a* are not collinear along the first upright 10*a*. In this embodiment, the dual muscle roller has a narrow and wide configuration depending on the orientation of the uprights 10*a*, 10*b* as shown in FIG. 11. The orientation depicted with solid lines in FIG. 11 shows the narrow configuration. The orientation depicted with dashed lines in FIG. 11 shows the wide configuration turned upside-down. The difference between narrow and wide configurations is the relative distance between the two handles 5*a*, 5*b* and the two rollers 20*a*, 20*b*. With the handles 5*a*, 5*b* spaced equally, the rollers 20*a*, 20*b* are closer together in the narrow configuration compared to the wide configuration.

Now the operation of the dual muscle roller embodiment 3 in FIGS. 11 and 12 will be detailed. The procedure to transition the dual muscle roller between narrow and wide configuration is the same as described with references to the first and second embodiments above. Although FIGS. 13-14 illustrate the operation of the first embodiment, these figures can also be referenced because the operation of the first and third embodiments is very similar. A user 60 picks up the dual muscle roller by grasping the first handle 5*a* in their right hand and the second handle 5*b* in their left hand such that the dual muscle roller assembly 3 is in front of the user's body. Thus, the handles 5*a*, 5*b* curve back toward the user 60 and the single lever joint 37 is in front with the roller axles 15*a*, 15*b* pointing rearward towards the user 60.

The user 60 adjusts the spacing between the rollers 20*a*, 20*b* by moving the handles 5*a*, 5*b* together or apart. The user 60 places the rollers 20*a*, 20*b* around a part of their body to massage. The user 60 brings the handles 5*a*, 5*b* together until the rollers 20*a*, 20*b* contact both sides of their body. The user 60 applies inward pressure on the handles 5*a*, 5*b* to create their desired massage force. The user 60 moves the handles 5*a*, 5*b* up and down in a cyclic manner, which causes the rollers 20*a*, 20*b* to roll against their body. The user 60 adjusts the pressure and spacing between the rollers 20*a*, 20*b* by adjusting the spacing of the handles 5*a*, 5*b* and the inward pressure applied to the handles 5*a*, 5*b*.

The procedure to transition the dual muscle roller between narrow and wide configuration is the same as described in the first embodiment. Starting from one configuration, the user 60 rotates the handles 5*a*, 5*b* away from each other to flip the dual muscle roller 3 into the opposite configuration. The user 60 then rotates the entire assembly 3 so that the handles 5*a*, 5*b* are at the top and the single lever joint 37 is at the bottom.

Several other features and structures are disclosed in U.S. Patent Application 62/210,950 entitled Adjustable Muscle Roller filed on Aug. 27, 2015, and U.S. Patent Application 62/376,882 entitled Dual Muscle Roller filed on Aug. 18, 2016. Each of these applications is incorporated in their entirety herein by reference.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend the following claims "and the embodiments in the specification to be strictly coextensive." *Phillips v. AHW Corp.,* 415 F.3d 1303, 1323 (Fed. Cir. 2005) (en banc).

The invention claimed is:

1. A dual muscle roller apparatus comprising:

a crossbeam with a first end and a second end;

a first upright in rotational connection to the first end of the crossbeam and a first handle connected at an end of first upright;

a second upright in rotational connection to the second end of the crossbeam and a second handle connected at an end of the second upright;

a first roller axle extending away from the first upright at a first position that is between the first handle and the first rotational connection to the crossbeam, and a first roller rotationally connected to the first axle such that the first roller rotates about the first roller axle;

a second roller axle extending away from the second upright at a second position that is between the second handle and the second rotational connection to the crossbeam, and a second roller rotationally connected to the second axle such that the second roller rotates about the second roller axle;

wherein the first roller axle and the second roller axle are separated by a distance and the distance is adjusted by:

(a) rotating the first upright about the first rotational connection with the crossbeam;

(b) rotating the second upright about the second rotational connection with the crossbeam; or (c) rotating the first upright about the first rotational connection with the crossbeam and rotating the second upright about the second rotational connection with the crossbeam.

2. The apparatus of claim 1 wherein the crossbeam is comprised of two crossbeam members.

3. The apparatus of claim 1 wherein the first handle curves away from the first upright and the second handle curves away from the second upright.

4. The apparatus of claim 1 wherein the first upright is bent at a first bend angle adjacent to the first position.

5. The apparatus of claim 4 wherein the second upright is bent at second bend angle adjacent to the second position.

6. The apparatus of claim 1 wherein the first upright further comprising a first upper upright and a first lower upright connected together at a first folding joint.

7. The apparatus of claim 6 wherein the second upright further comprising a second upper upright and a second lower upright connected together at a second folding joint.

8. The apparatus of claim 7, wherein the second joint is constructed such that when the second upper upright is folded about the second folding joint, the second upper upright is substantially parallel to the second roller axle.

9. The apparatus of claim 7 wherein the second lower upright is in rotational connection with the second end of the crossbeam such that the second lower upright rotates in a second rotational plane and the second upper upright rotates about the folding joint in a second rotational joint plane.

10. The apparatus of claim 9, wherein the second rotational plane is substantially orthogonal to the second rotational joint plane.

11. The apparatus of claim 6, wherein the first folding joint is constructed such that when the first upper upright is folded about the first folding joint, the first upper upright is substantially parallel to the first roller axle.

12. The apparatus of claim 6 wherein the first lower upright is in rotational connection with the first end of the crossbeam such that the first lower upright rotates in a first rotational plane and the first upper upright rotates about the folding joint in a first rotational joint plane.

13. The apparatus of claim 12, wherein the first rotational plane is substantially orthogonal to the first rotational joint plane.

14. The apparatus of claim 1, wherein the rotational connection between the first roller axle and the first roller is detachable such that the first roller can be removed and replaced.

15. The apparatus of claim 1, wherein the first handle is selected from a group consisting of a t-handle and a spherical handle.

16. The apparatus of claim 1, wherein rotational connection of the first upright to the first end of the crossbeam is selected from a group consisting of a through-bolt lever joint and a scissor lever joint.

17. A dual muscle roller apparatus comprising:

a first upright with a first end and a second end and a first handle connected at the first end of first upright;

a second upright with a first end and a second end, wherein the second end of the second upright is in rotational connection with second end of the first upright, and a second handle connected at the first end of the second upright;

a first roller axle extending away from the first upright at a first position that is between the first and second ends of the first upright, and a first roller rotationally connected to the first roller axle such that the first roller rotates about the first roller axle;

a second roller axle extending away from the second upright at a second position that is between the first and second ends of the second upright, and a second roller rotationally connected to the second roller axle such that the second roller rotates about the second roller axle;

wherein the first roller axle and the second roller axle are separated by a distance and the distance is adjusted by rotating the first upright about the rotational connection with the second upright.

18. The apparatus of claim 17 wherein the first upright is bent at a first bend angle adjacent to the first position.

19. The apparatus of claim 17 wherein the first upright further comprising a first upper upright and a first lower upright connected together at a first folding joint.

20. The apparatus of claim 19 wherein the first lower upright is in rotational connection with the second upright such that the first lower upright rotates in a first rotational plane and the first upper upright rotates about the folding joint in a first rotational joint plane, wherein the first rotational plane is substantially orthogonal to the first rotational joint plane.

* * * * *